US007633002B2

(12) United States Patent
Inouye

(10) Patent No.: US 7,633,002 B2
(45) Date of Patent: Dec. 15, 2009

(54) PIANO KEY ASSEMBLY

(76) Inventor: Asami Inouye, 180 Riverside Blvd., New York, NY (US) 10069

( * ) Notice: Subject to any disclaimer, the term of this patent is extended or adjusted under 35 U.S.C. 154(b) by 0 days.

(21) Appl. No.: 12/043,493

(22) Filed: Mar. 6, 2008

(65) Prior Publication Data

US 2009/0223347 A1 Sep. 10, 2009

(51) Int. Cl.
*G10C 3/12* (2006.01)

(52) U.S. Cl. ..... 84/433; 84/432

(58) Field of Classification Search ..... 84/432, 84/433

See application file for complete search history.

(56) References Cited

U.S. PATENT DOCUMENTS

| | | | | | |
|---|---|---|---|---|---|
| 633,915 | A | | 9/1899 | Smith | |
| 1,589,745 | A | * | 6/1926 | Federle | 84/433 |
| 2,031,748 | A | * | 2/1936 | Vietor | 84/433 |
| 4,524,669 | A | * | 6/1985 | Yamamoto et al. | 84/433 |
| 5,406,875 | A | * | 4/1995 | Tamai et al. | 84/433 |
| 5,585,582 | A | * | 12/1996 | Stanwood | 84/432 |
| 5,796,024 | A | * | 8/1998 | Stanwood | 84/433 |
| 6,096,959 | A | | 8/2000 | Davide | |
| 6,531,651 | B2 | * | 3/2003 | Kanemitsu et al. | 84/433 |
| 6,693,235 | B2 | * | 2/2004 | Ookubo | 84/433 |
| 6,774,294 | B2 | * | 8/2004 | Kugimoto et al. | 84/433 |
| 7,186,907 | B2 | * | 3/2007 | Inouye | 84/236 |
| 7,262,351 | B2 | | 8/2007 | Inouye | |
| 7,345,235 | B2 | * | 3/2008 | Izutani et al. | 84/720 |
| 2001/0027712 | A1 | * | 10/2001 | Kanemitsu et al. | 84/433 |
| 2003/0047061 | A1 | * | 3/2003 | Kugimoto et al. | 84/433 |
| 2004/0123728 | A1 | * | 7/2004 | Inoue | 84/719 |
| 2005/0235804 | A1 | * | 10/2005 | Inouye | 84/236 |
| 2009/0038466 | A1 | * | 2/2009 | Elliger | 84/433 |

* cited by examiner

*Primary Examiner*—Jeffrey Donels
*Assistant Examiner*—Robert W Horn
(74) *Attorney, Agent, or Firm*—Martin Fleit; Paul D. Bianco; Fleit Gibbons Gutman Bongini & Bianco PL

(57) ABSTRACT

A piano key assembly for a pianoforte in which weights are mounted on a keystick to have a center of gravity between a first point along said keystick halfway between the pivot point of the keystick and the end struck by the pianist and a second point halfway between the pivot point and the first point and wherein all the weights are located relative to the keystick between the pivot point and the first point. Optionally, holes are made in the keystick between the first point and the end struck by the pianist.

6 Claims, 5 Drawing Sheets

PIANO KEY ASSEMBLY

BACKGROUND OF THE INVENTION

1. Field of Invention

The invention relates to an improvement to a piano key assembly for a pianoforte (grand piano) having weighted keysticks to achieve an improved dynamic response.

2. Description of Prior Art

The technique of keystick balancing for a pianoforte (that is, a grand piano) has seen little change in the past 100 years. U.S. Pat. No. 633,915 to Smith teaches the placement of lead weights within the keystick to balance a key in such manner as to make it properly responsive to the touch of the pianist. More recently, U.S. Pat. No. 5,585,582 to Stanwood ("Stanwood 1") teaches a method to determine the proper amount of off-setting weight to place within a keystick during manufacturing to provide a more uniform feel when playing. U.S. Pat. No. 5,796,024 to Stanwood ("Stanwood 2") teaches a method for fixing the amount of off-setting weight and varying an additional calibration weight to achieve the desired balance. U.S. Pat. No. 6,096,959 to Davide applies keystick balancing to an upright piano key mechanism with the addition of lead weights to the keystick and the wippen. U.S. Pat. No. 6,531,651 to Kanemitser et al. discloses a musical instrument key with a means for simplifying the adjustment of weights.

Conventional balancing methods and recent improvements such as these focus on the static balance of the keystick and ignore the effect weigh-off has on the internal inertia of the key. Lead weights placed near the "ivory end" of keystick require the piano player to move the weights a greater distance at a greater speed than if the weight were placed closer to the pivot point (fulcrum). (As used hereinafter, the term "ivory end" of a keystick is intended to denote the end of the keystick that is pressed down by the finger(s) of a piano player, regardless of whether the keystick does or does not have "ivory", or whether the keystick is or is not associated with a "white" key or "black" key.) Stanwood 2 and Davide, both improvements to the teaching of Stanwood 1, increase the keystick inertia with the addition of more weight. While both may create an instrument with keysticks uniformly balanced, the dynamic performance of the instrument is negatively impacted by the increased inertia.

U.S. Pat. No. 2,031,748 to Vietor discloses a technique for balancing the keys of a piano keyboard by the placement of lead weights in the keysticks. Unlike the other prior art references, this patent is concerned with the placement of off-setting weights to maximally reduce the inertia of the keys. In particular, this patent teaches the placement of a large weight and small weight immediately adjacent the pivot point of the keystick. While this arrangement does, indeed, reduce the inertia to an absolute minimum, it does not provide sufficient off-setting weight for a piano key.

My earlier invention, as expressed and claimed in my U.S. Pat. No. 7,186,907, teaches providing a piano key assembly for a pianoforte—that is, a grand piano—which is optimally balanced, using lead weights, for improved "feel" and performance of the instrument. The content of U.S. Pat. No. 7,186,907 is incorporated herein by reference in its entirety. This is accomplished by property locating the center of gravity of the lead weights along each keystick of the key assembly and adjusting the amount of weight for optimal static and dynamic performance of the pianoforte. More particularly, the center of gravity of the weights is arranged along each keystick between a first point, halfway between the pivot point and the ivory end of the keystick, and a second point along the keystick halfway between the first point and the pivot point. The amount of weight applied at this center of gravity is preferably adjusted so that the average of the static downweight and upweight for each keystick is in the range of 10 to 20 grams heavier than the conventionally accepted value for that keystick on a keyboard.

SUMMARY OF THE INVENTION

It is a principal object of the present invention to improve the piano key assembly as shown and described in U.S. Pat. No. 7,186,907. This patent describes how the piano touch can be improved by moving the lead weights' center of gravity to reduce inertia, when offsetting the weight of the top action. However, this doesn't completely eliminate the possibility of installing any number of lead weights in the region closer to the ivory end than the first point located halfway between the ivory end of each key and the pivot point when necessary in order to achieve the desired balance weight.

The new improved invention avoids adding any lead weights in certain preselected locations of the key (between the first point and the ivory end) with most, if not all, of the weights being located in a first preselected section of the key which lies between the first point and the pivot point. The only exception to the foregoing concerns the extreme treble region where the hammers are very small and light, and adding weights in a second preselected section adjacent to the first preselected section (between the pivot and the capstan) may be allowed in order to achieve ideal responsiveness.

It is a further object of the invention to provide in a piano key assembly for a pianoforte for causing a musical tone to be played by the pianoforte, said key assembly comprising, in combination: a) an elongate keystick having two ends, one end of said keystick being adapted to be depressed by a human finger; b) a fulcrum for holding said keystick at a pivot point substantially midway between said two ends; c) at least one weight arranged on said keystick to impart a desired static balance weight thereto, said at least one weight providing a center of gravity between a first point along said keystick, halfway between said pivot point and said ivory end, and second point halfway between the first point and said pivot point, thereby to improve the dynamic response of said keystick.

It is a further object of the invention to provide in a pianoforte having a plurality of piano key assemblies, as defined above, arranged side by side on a keyboard, and numbered consecutively from the lowest key assembly in the bass register (#1) to the highest key assembly in the treble (#88). (The system for numbering keys is the one universally used in the art.) The improvement of the invention concerns said weight being mounted on the keystick between the pivot point and the first point to achieve a balance weight of between 50 to 60 grams for the lowest key assembly in the bass (Note #1) and 40 to 50 grams for the highest key assembly in the treble (Note #88), and all other keys smoothly tapered or graduated in between.

It is still a further object of the invention, optionally, to provide in a piano key assembly as defined above, further holes defined in said keystick between the first point and the ivory end.

This object, as well as other objects, which will become apparent from the discussion that follows, is achieved, in accordance with the present invention, piano keys weighted according to the present invention permit better control, action and more beautiful tone.

For a full understanding of the present invention, reference should now be made to the following detailed description of the preferred embodiments of the invention as illustrated in the accompanying drawings.

DESCRIPTION OF THE PREFERRED EMBODIMENTS

The earlier invention, described with reference to FIGS. 1 to 3 of the drawings, shows the optimal positioning/placement of the lead weights and the amount of force required in the dynamic operation of the key.

Figure 1:
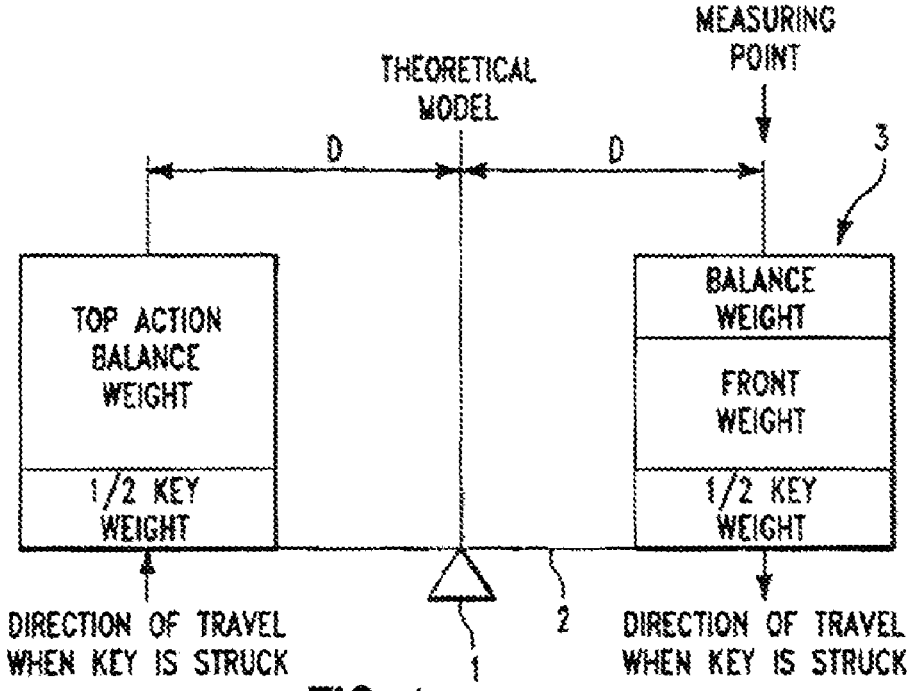
FIG. 1 shows the state of the prior art according to my earlier invention, U.S. Pat. No. 7,186,907, and shows a theoretical model of the weights acting on a piano key, as shown in Stanwood 1.

FIG. 1 represents the weights in a single piano keystick as taught by Stanwood 1. Each keystick is a simple balance beam which consists of a keystick 2, a pivot point 1 and a hammer assembly and wippen which apply a force to the keystick 2. Force applied to the one end of the piano key, by the piano player, causes downward movement of the ivory end of the keystick. The downward force creates movement which translates to an upward force applied to the wippen and hammer assembly by way of the capstan screw that projects upward from the keystick. When depressing a key, the piano player must overcome the imbalance in the key, the friction from various sources including the wippen and hammer assembly as well as the key itself, and the internal inertia of the key.

The practice of keystick balancing places offsetting lead weights in the keystick in order to achieve a uniform downweight for all keys. In obtaining the proper static balance, the critical element is selecting the correct amount of weight to produce an offsetting downward force of the static force exerted by the hammer-assembly and wippen. In fact, when balancing a keystick to achieve a static balance, the position of the weight, relative to the pivot point 1, is irrelevant. As shown in FIG. 2, the placement of 40 grams a distance of D from the pivot point 1 is equal to 20 grams at a distance of 2D or 10 grams at 4D. The amount of torque generated by each is equal to 40D grams. Although positioning of weight, relative to the pivot point, is irrelevant for static balancing, the placement is critical to the dynamic performance.

Figure 2:
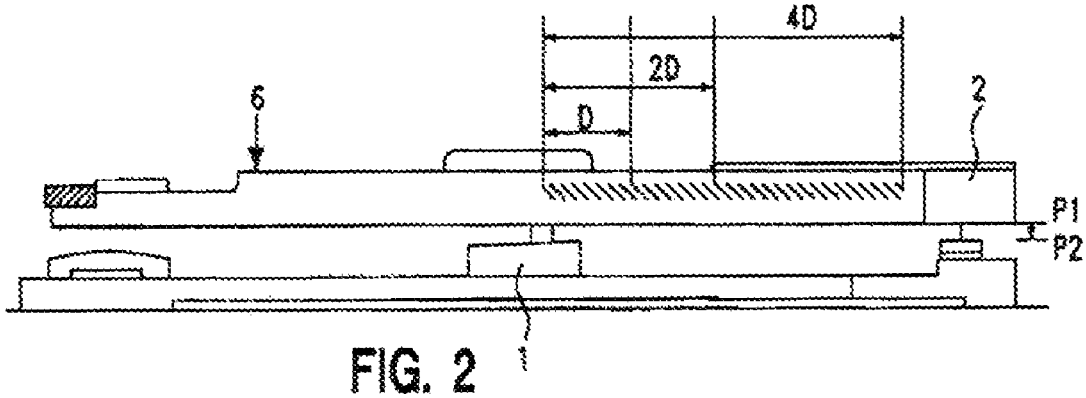
FIG. 2 shows the state of the prior art according to my earlier invention, U.S. Pat. No. 7,186,907, and is a side view of a piano key showing the distance of applied weight from the pivot point.

As will be appreciated from considering FIG. 2, playing a note is a dynamic process. When depressing a key the ivory end of the keystick moves from position P1 to position P2. This distance of keystick travel is directly proportional to the distance along the keystick from the pivot point. According to the earlier patent, improvement in the dynamic performance is accomplished by repositioning the center of gravity of the off-setting weights in closer proximity to the pivot point of the keystick. In the prior art, the center of gravity of all the lead weights was placed as close as possible to the ivory end of the key to minimize the number of weights required. The most commonly used lead weights in a keystick weigh about 14.5 grams each. The size of weights used in the keys is different among various manufacturers. For example, Steinway & Sons primarily uses 14 g (½" diameter) weights and some 8.5 g (⅜" diameter) weights. Yamaha uses 20 g weights (7/16" diameter). These weights are placed in holes that are made/bored in the keystick, which to preserve the structural integrity of the keystick have to be separated from one hole to the next by a solid wood section which is at least equal in length to the diameter of the holes. With the center of gravity placed as close to the ivory end of the keystick as possible, many of the conventional piano required as many as five or six lead weights in each keystick in the bass region, three or four lead weights in each keystick in the midsection and one or two lead weights on each keystick in the treble.

Figure 3:
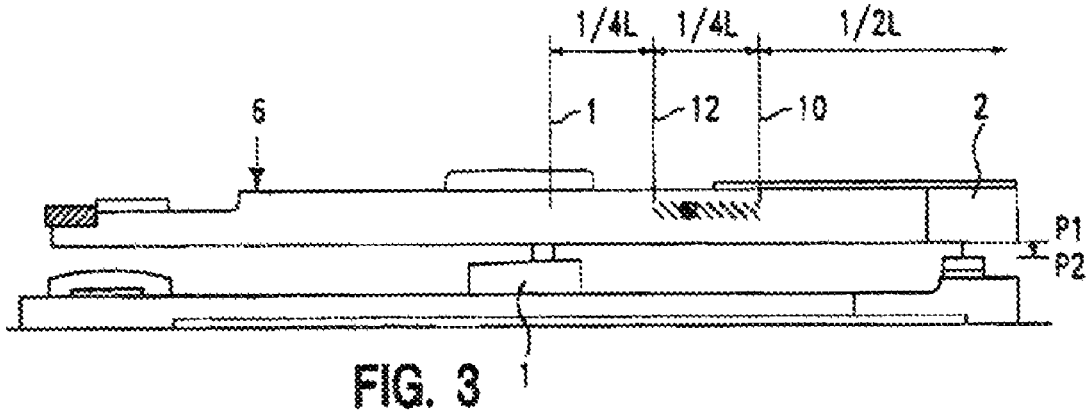
FIG. 3 shows the state of the prior art according to my earlier invention, U.S. Pat. No. 7,186,907, and is a side view of a keystick with lead weights positioned in accordance with the earlier invention.

Referring to FIG. 3, it was found, by experimentation, that the optimum position for the center of gravity of the off-setting lead weights is located between a first point 10 which is midway between the pivot point 1 and the ivory end of the keystick 2 and a second point 12 which is halfway between the first point 10 and the pivot point 1. In other words, if the total distance between the pivot point and the ivory end of the keystick is L, the first point 10 is a distance one-half L from the end of the keystick and the second point 12 is a distance one-quarter L away from the first point 10 in the direction of the pivot point 1.

Even though the center of gravity of the lead weights is moved from the conventional region between the first point 10 and the ivory end of the keystick to the region between the first point 10 and the second point 12, it may not be necessary to add an additional lead weight to the keystick. It has been found by experimentation to be advantageous if the average of the static downweight and static upweight of the keystick 2, so balanced, is in the range of 10 to 20 grams heavier than the conventionally accepted value for that keystick on a keyboard. The conventional values are 45-55 grams for the downweight and 19-29 grams for the upweight, for a conventional average in the range of 32 to 42 grams. According to the invention, this average may be increased to the range of 42 to 62 grams. Preferably also, the average of the static downweight and static upweight on each key is at least 50 grams for the lowest key assembly in a grand piano (e.g., key No. 1) and at least 40 grams for the highest key assembly (e.g., key No. 88).

According to my earlier invention, notwithstanding this permissible increase in the average of downweight and upweight, if additional weight is necessary, a lead weight can be glued beneath the keystick or placed in a hole that is closer to the ivory end of the keystick than the midway point 10.

Figure 4:
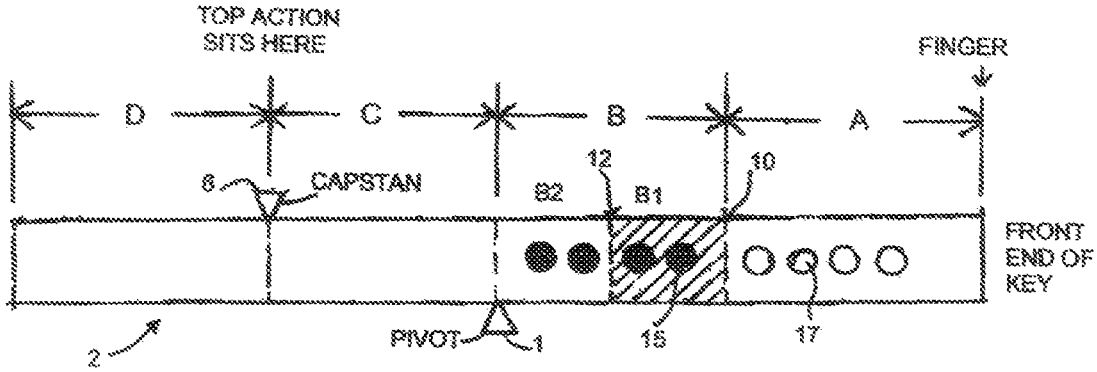
FIG. 4 shows schematically a piano key divided into four sections.

Referring now to the improvement of the present invention, attention is directed to FIG. 4 which shows for ease of discussion a key stick 2 roughly divided into four quadrants or sections: Section A—front end of the key stick 2 to ½ way toward the pivot 1; Section B—pivot 1 to ½ toward the front end of the key stick 2; Section C—pivot 1 to capstan screw 6 [where the weight of the top action (wippen and hammer assembly) sits on the key stick 2]; Section D—capstan 6 to rear end of the key stick 2.

My earlier patent describes how the piano touch can be improved by moving the center of gravity of the lead weights 15 to Section B1 (front half of B, shown as hatched) to reduce inertia, when offsetting the weight of the top action. While it is recommended that all weights 15 be installed in Section B, this doesn't completely eliminate the possibility of installing any number of lead weights 15 in Section A, when there is not enough room in Section B, as long as the center of gravity falls somewhere within Section B1.

The new improved technique of the present invention avoids adding any lead weights 15 in Section A; all weights 15 are in Section B only. Section A should be as light as possible. Optionally, in order to accomplish this, one or more holes 17 can be bored and left empty.

If there is not enough room in Section B to achieve the optimal balance weight, gluing additional weights at the bottom of the key stick 2 is an option (bar type weights are acceptable). Another option is to reduce the total weight of top action upon the capstan; there are many ways to accomplish this. Yet another option is to change the key stick ratios (the ratio between capstan to pivot and key stick front to pivot) to reduce the number of weights needed.

According to the invention, as a rule, the center of gravity is in Section B1 only. The only exception to this rule is the extreme treble region. In the extreme treble region, where the hammers are very small and light, adding weights in Section C may be allowed in order to achieve ideal responsiveness. Accordingly, under these circumstances it is possible for the center of gravity to drift toward Section B2 and/or Section C. Thus, in the extreme treble section there are four different possibilities for the placement of lead weights in this section: (1) lead weight(s) is placed only in section B of the key stick (see FIG. 4 for sections A, B, C, and D of the key); (2) no lead weight is place in key; (3) lead weights are placed in sections B and C of the key; and (4) lead weight(s) is placed only in section C of the key.

These structural improvements are based on the theories and experimental studies described below.

Figure 5:
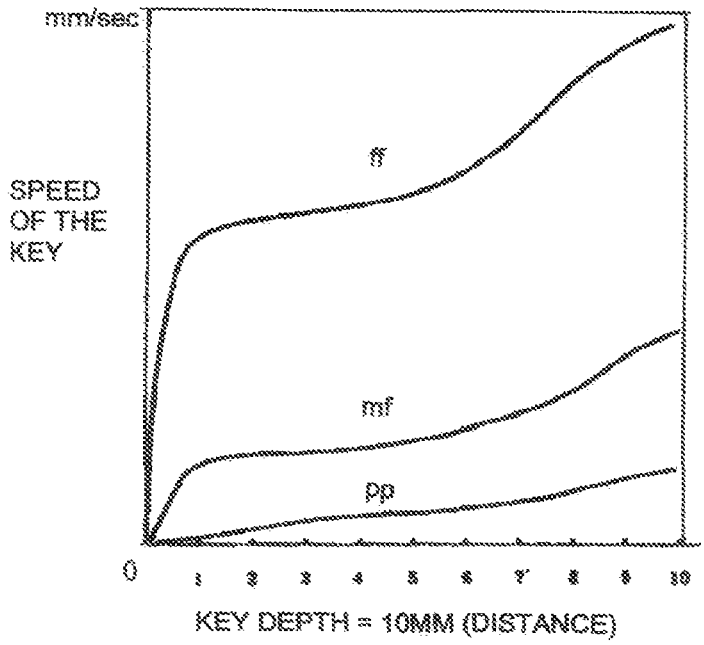
FIG. 5 shows the speed of a key during a keystroke for ff (fortissimo), mf (mezzo forte) and pp (pianissimo).
Figure 6:
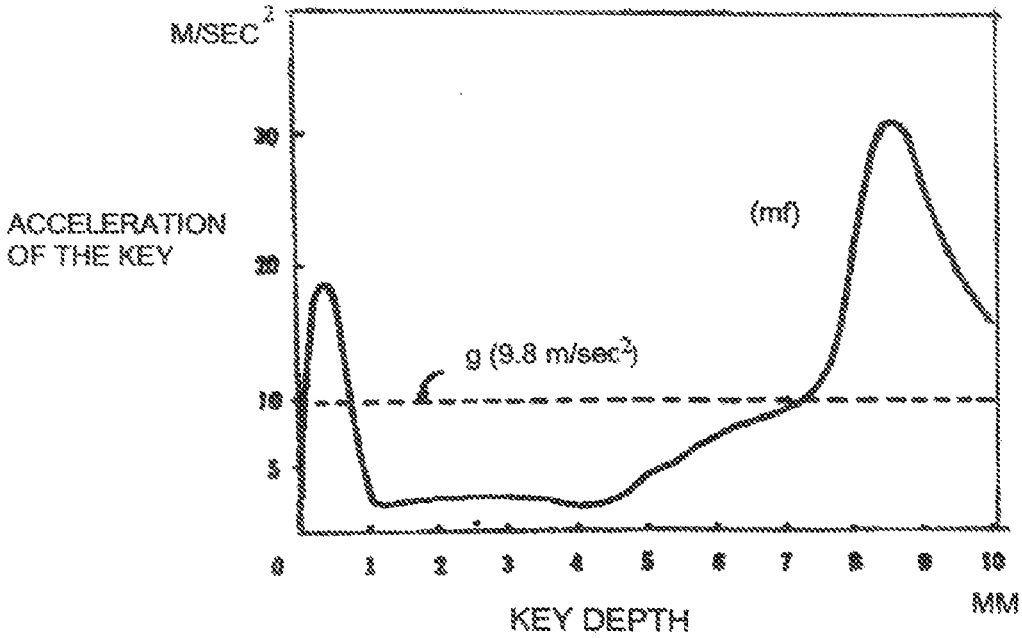
FIG. 6 shows the acceleration of a key during a keystroke for mf (mezzo forte).

Referring now to FIGS. 5 and 6, one can see that neither the speed of the key stick 2 nor the key stick's acceleration is uniform within a single key stroke (see graphs). These parameters also vary greatly from pianist to pianist, from one instrument to another, or in different acoustic conditions. The following is an example of but one pianist's touch at various dynamic ranges, expressed as acceleration.

| | |
|---|---|
| pianissimo | 1-2 m/sec$^2$ |
| piano | 3-5 m/sec$^2$ |
| mezzo piano | 5-10 m/sec$^2$ |
| mezzo forte | 10-20 m/sec$^2$ |
| forte | 20-30 m/sec$^2$ |
| fortissimo | 30-60 m/sec$^2$ |

The formula used for calculating the effect of a lead weight 15 to the touch weight (F) is as follows:

When considering 3 torques working simultaneously on a key stick, the sum of the torque caused by the weight of lead and the torque caused by the inertia of lead balances out with the torque caused by the finger pressing the key.

The effect of lead weights that a pianist's finger feels at a certain dynamic level is equal to [(torque caused by the weight of lead)+(torque caused by lead's inertia)]/(distance from the pivot to the front end of the key), or stated in another manner is Touch Weight F=[−(weight of lead)×(lead's distance from pivot)+(lead's mass)×(acceleration of lead)×(lead's distance from pivot)]/(distance of finger to the pivot).

Torque caused by the weight of lead=−(w×b)

Torque caused by the inertia of lead=w/g×a/c×b$^2$=w/g×a×b/c×b

Torque caused by the finger pressing the key=F×c $$F=[-(w\times b)+(w/g\times a\times b/c\times b)]/c \qquad \text{(EQ 1)}$$

Where, g=gravitational force (9800 mm/sec$^2$)

w=weight of lead weight (gram)

a=acceleration of the key (mm/sec$^2$)

b=position of lead weight from the pivot (mm)

c=distance from pivot to the front end of the key stick (mm)

w/g=lead's mass a×b/c=lead's acceleration a/c=angular acceleration

Since the lead's inertia is proportional to the square of its distance from the pivot, it is clear that the distance has a greater impact on Touch Weight than the weight of the lead itself.

The following is a comparison of the effects of a 20 gram weight vs. a 40 gram weight placed at 180 mm and 90 mm, respectively, from the pivot 1 (the speed of key stick acceleration used for each loudness is only a rough estimation of the average for that touch; the distance of fingers to pivot being 240 mm), see Table I.

TABLE I

| | | F1 (20 g @ 180 mm) | F2 ((40 g @ 90 mm) |
|---|---|---|---|
| pppp | (0 m/sec$^2$) | 15 g lighter | 15 g lighter |
| p | (2 m/sec$^2$) | 13 g lighter | 14 g lighter |
| mf | (10 m/sec$^2$) | 3.5 g lighter | 9 g lighter |
| f | (20 m/sec$^2$) | 8 g heavier | 3.5 g lighter |
| ff | (30 m/sec$^2$) | 19 g heavier | 2 g heavier |
| ffff | (60 m/sec$^2$) | 54 g heavier | 19 g heavier |

F1 = {−(20 × 180) + [(20/98000) × (acceleration of lead) × 180]}/240
F2 = {−(40 × 90) + [(40/98000) × (acceleration of lead) × 90]}/240

Figure 7:
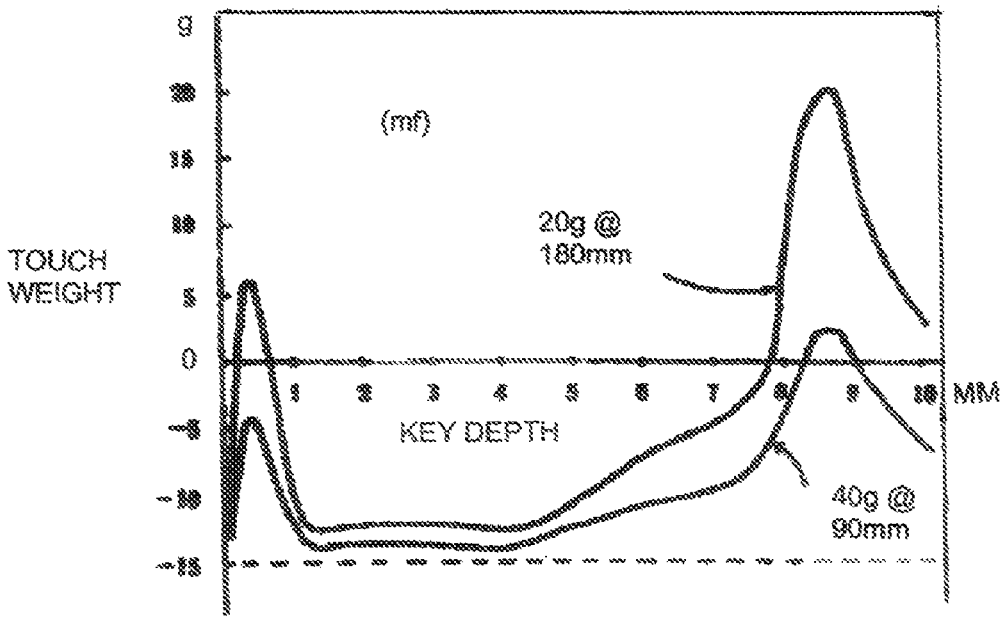
FIG. 7 shows the effect of different placement of lead weights upon touch weight.

It becomes apparent that when a lead weight accelerates faster than the force of gravity (9.8 m/sec$^2$) it behaves contrary to its intended purpose, see FIG. 7. When there are multiple lead weights installed in Section A (3 or 4 leads are common), the compounded effect of inertia is enormous. As long as the lead weights are placed in the suggested area Section B, they travel much slower than the finger speed, so the adverse effect of the lead's inertia is minimized.

Since the piano is a doubly percussive instrument (keys are hit by the fingers and strings hit by the hammers), vibrations from both sources are instantaneously transmitted to and merged at the soundboard to create the tone we know as the sound of a piano. (Original findings were published in Piano Quarterly 1979). The greater the inertia of the keys, the noisier the impact of fingers hitting the keys, so this creates a "dirty" sound. When lead weights 15 are totally eliminated from Section A, overall inertia of the key stick 2 is greatly reduced and the touch is greatly improved.

As an optional enhancement, boring 1 to 4 holes 17 in the same section will help reduce the inertia even more, greatly improving the tone quality. Like the weights 15, the holes 17 must be spaced a distance equal to their diameter. This benefit is prominent especially in ff-ffff touch, and more so in larger pianos that have longer keys with inherently greater inertia.

Reduced noise level at the "attack" portion of the sound contributes to a more beautiful, sustained, and slower decaying tone. The noisier is the tone (the more energy at the onset), the faster is the decay. The keys come up faster, which forces the dampers down faster as well. All of these factors help the tone become extremely clean, clear and crisp.

The following is the effect of the "inertia" of 3 holes 17 (of the same diameter as 20 g weights 15) bored in Section A (125 mm, 150 mm, 175 mm from pivot. The finger position is 240 mm from the pivot. The total weight of the displaced wood=−3.3 g.)

| | |
|---|---|
| pppp (0 m/sec$^2$) | 0 g |
| p (2 m/sec$^2$) | −0.2 g |
| mf (10 m/sec$^2$) | −1.3 g |
| f (20 m/sec$^2$) | −2.6 g |
| ff (30 m/sec$^2$) | −3.9 g |
| ffff (60 m/sec$^2$) | −7.9 g |

The ideal balance weight can be determined by measuring the "downweight" and "upweight" of each key stick (with the top action sitting on the capstan), adding the two numbers together and dividing by two, thus, eliminating the friction factor. Then, record the numbers on a graph from #1 to #88 key and determine the target balance weight to be achieved by adding lead weights. (Downweight=minimum amount of weight placed on the front end of the key that causes the key to slowly drop; Upweight=maximum weight that the key can lift. Balance weight=theoretical downward force required to press down the key without friction, that is, when Downweight=Upweight=Balance weight.)

When considering the balancing of keys, only those measurements (downweight and upweight) taken at the 10 mm from the end of each key are used. This is more or less the farthest point from the pivot where a measuring gauge (approximately 20 mm diameter) can be placed and a finger can press safely without falling off the edge. We don't worry about the fact that in actual playing, pianists can press the keys anywhere accessible/visible to them (from the front edge of the key to 150 mm inward toward the pivot for the white keys and 100 mm for the black keys). So, for this description, for all practical purposes, "front end of the key," "ivory end" and "finger position" all mean one and the same thing: 10 mm from the front edge of the key.

Figure 8A:
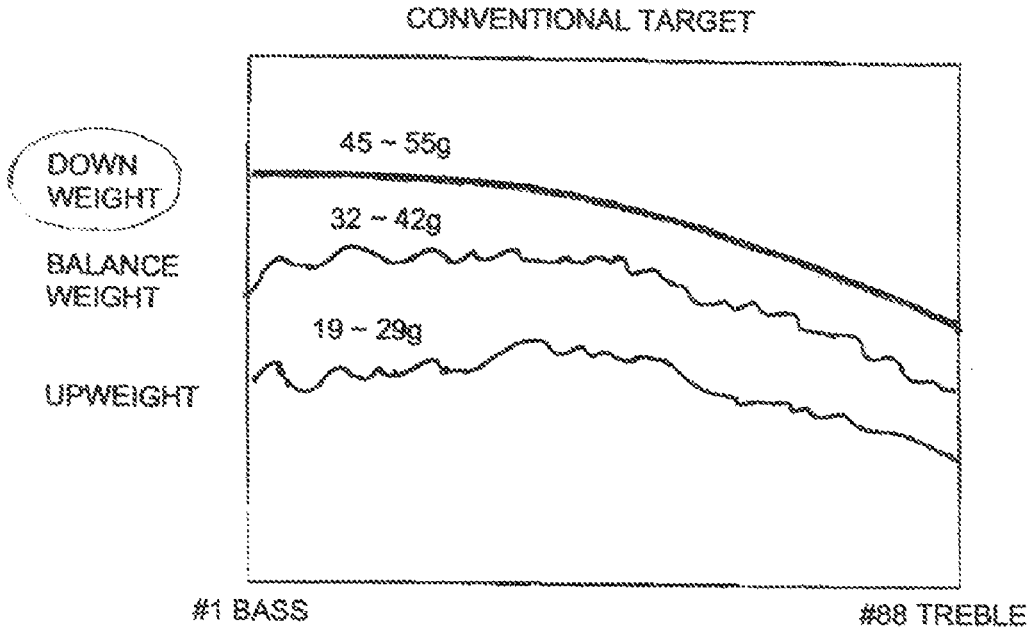
FIGS. 8*a* and 8*b* show some examples of the downweight of bass to treble (notes #1 to #88) for the conventional target and the balance weight for the new target according to the invention, respectively.
Figure 8B:
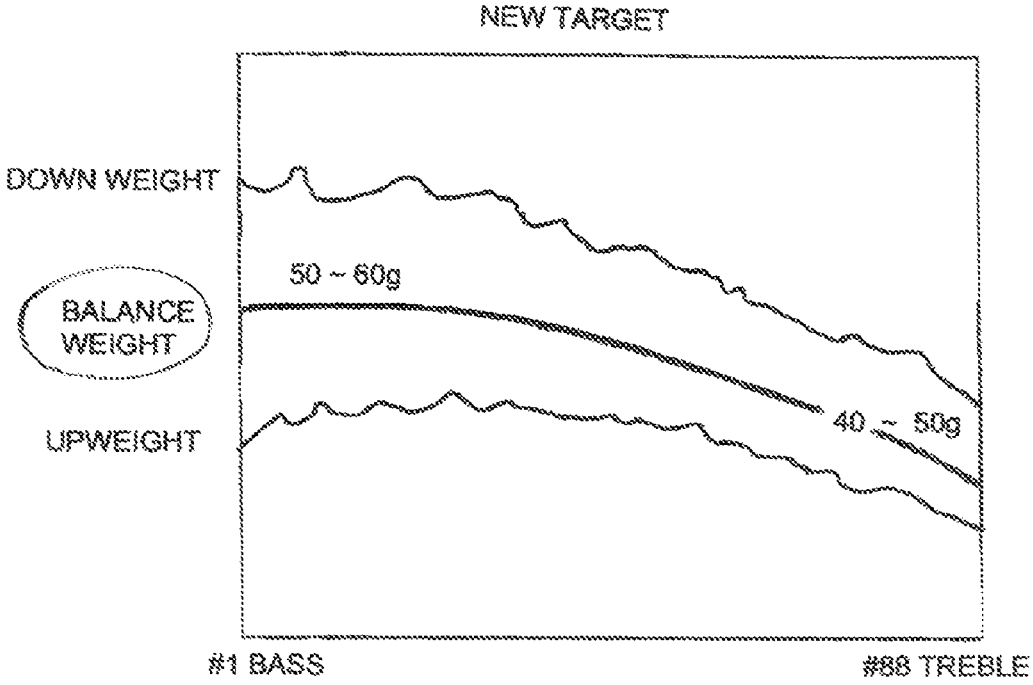

As shown in FIG. 8*a*, conventionally piano manufacturers try to achieve 50 g±static downweight, totally ignoring the effect of inertia. In the new invention described herein, the target is the ideal balance weight, which should be from a high of about 50 g-60 g at the bass to a low of about 40 g-50 g at the treble, smoothly tapered from the bass to treble (note #1-note #88), while maintaining inertia at minimum, as shown in FIG. 8*b*.

An important point to remember, however, is that while the tone quality is dramatically improved by the reduced inertia, the faster key returns might sometimes result in increased noise level in the action mechanism if the parts are too loose, worn, or of a poor quality. If that is the case, a choice must be made between whether to slow down the key (by lowering the target balance weight toward the lighter side), or to replace or repair the action parts.

Figure 8C:
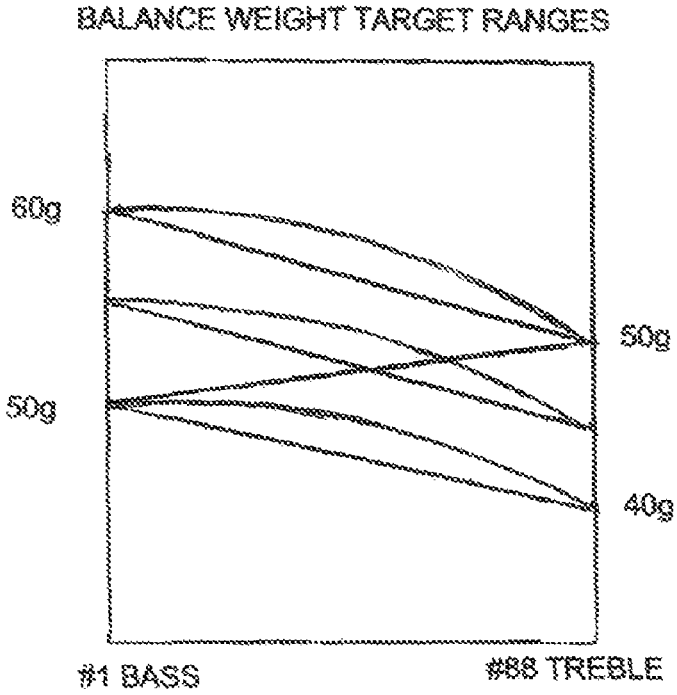
FIGS. 8*c* and 8*d* show the balance weight of bass to treble (notes #1 to #88) for the new target according to the invention, illustrating how the curves flatten over usage.
Figure 8D:
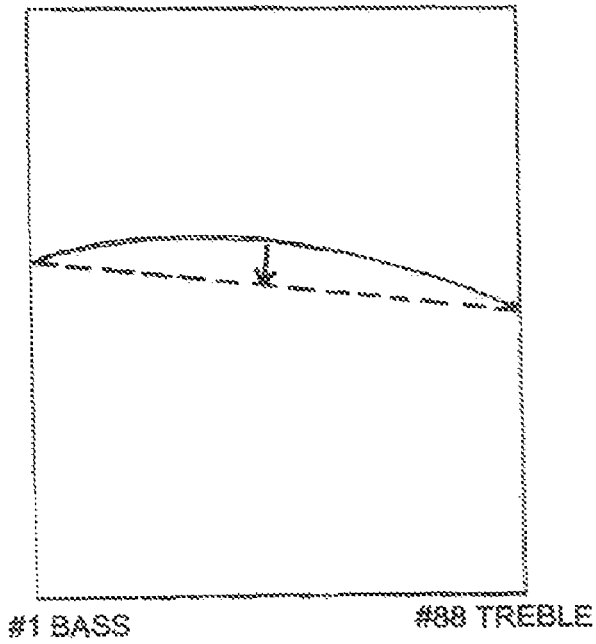

The modified target weight ranges of 50-60 g for Note #1 in the bass and 40-50 g for Note #88 in the treble are further illustrated in FIGS. 8*c* and 8*d*. Within these ranges, the connecting tapered or graduated line could be straight or slightly curved, as illustrated in FIG. 8*d*. As the center section of the keyboard is played more, so the hammers will get lighter from wear and repeated filing. This causes the curved balance weight line eventually to be flattened anyway (unless the hammers are covered with the voicing tapes as described in U.S. Pat. No. 7,262,351).

The heavier downweight makes the keys feel firmer and much easier to control when played soft and the reduced inertia makes the keys feel lighter when played loud. The heavier upweight drives the key to original position faster without key bounce or flutter. Touch sensitivity is maximized and keys feel extremely responsive and natural to a pianist's touch.

A piano with its key assembly modified according to the invention is exceptional in every way: repetition, flexibility and control at every level. The invention also enables a certain tactility which makes it a joy to play allowing all physical interference to disappear so that a player can now, for the first time, devote himself/herself completely to the music.

Creating the standardized procedure for determining exactly how weights should be arranged in the keys in Section B is not simple, because there are so many subtle variations in the action metrology and the parts specifications. Once all the necessary data and measurements are made available, the optimum ranges for the target balance weight can be customized for each model of pianos from various manufacturers.

There has thus been shown and described an improved novel piano key assembly which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a pianoforte having a plurality of piano key assemblies arranged side by side on a keyboard and numbered consecutively from the lowest key assembly in the bass register (#1) to the highest key assembly in the treble (#88) for causing a musical tone to be played by the pianoforte, each said key assembly comprising, in combination:

a) an elongated keystick having two ends, one end of said keystick being adapted to be depressed by a human finger; b) a fulcrum constituting a pivot point for pivotally holding said keystick substantially midway between said two ends; and c) said keystick having a static balance weight, the improvement comprising:

a. the keystick being notionally divided into quadrants with the first quadrant being at the end to be struck by the finger of the player, the second quadrant lying between the pivot point and the first quadrant, the fourth quadrant lying at the opposite end to the first quadrant, and the third quadrant lying between the pivot point and the fourth quadrant, b. said keystick being modified to achieve a balance weight of between 50 to 60 grams for the lowest key assembly in the bass register (#1) with the balance weight tapered to 40 to 50 grams for the highest key assembly in the treble register (#88) for improving the dynamic response of said keystick;

c. said keystick characterized by at least one weight mounted on the keystick in the second quadrant; and d. the first quadrant of the keystick being free of any added weights and containing from 0 to 4 empty holes to reduce weight.

2. In a pianoforte having a plurality of piano key assemblies as defined in claim 1 wherein offsetting weight on each key assembly provides a center of gravity lying in the second quadrant.

3. In a pianoforte having a plurality of piano key assemblies as defined in claim 2 wherein the extreme treble range is further modified by placing a weight closer to the fulcrum so that the center of gravity lies closer to the fulcrum.

4. In a piano key assembly as defined in claim 1, further including at least one hole defined in said keystick in the first quadrant.

5. In the extreme treble range of a piano key assembly for a pianoforte for causing a musical tone to be played by the pianoforte in an extreme treble range, said extreme treble range key assembly comprising, in combination: a) an elongate keystick having two ends, one end of said keystick being adapted to be depressed by a human finger; b) a fulcrum for holding said keystick at a pivot point substantially midway between said two ends; c) said keystick having a static balance weight;

the improvement comprising the extreme treble range keystick is notionally divided into quadrants with the first quadrant being at the end to be struck by the finger of the player, the second quadrant lying between the pivot point and the first quadrant, the fourth quadrant lying at the opposite end to the first quadrant, and the third quadrant lying between the pivot point and the fourth quadrant, said extreme treble range keystick being modified to achieve a balance weight of between 40 to 50 grams by one of (i) at least one lead weight mounted on the keystick in the second quadrant, (ii) at least one weight in the third quadrant, (iii) at least one weight in each of the second and third quadrants, and (iv) no weight in any quadrant, with all other regions of the keystick free of added weights.

6. In the extreme treble range of a piano key assembly as defined in claim 5, further including an empty hole defined in said keystick in the first quadrant.

* * * * *